US007446475B2

(12) United States Patent
Chen et al.

(10) Patent No.: US 7,446,475 B2
(45) Date of Patent: Nov. 4, 2008

(54) ALIGNMENT MARK AND PLASMA DISPLAY PANEL COMPRISING THE ALIGNMENT MARK

(75) Inventors: Po-Cheng Chen, Yonghe (TW); Jiun-Han Wu, Sanchong (TW)

(73) Assignee: AU Optronics Corp., Hsinchu (TW)

( * ) Notice: Subject to any disclaimer, the term of this patent is extended or adjusted under 35 U.S.C. 154(b) by 85 days.

(21) Appl. No.: 10/797,867

(22) Filed: Mar. 10, 2004

(65) Prior Publication Data

US 2005/0140298 A1 Jun. 30, 2005

(30) Foreign Application Priority Data

Dec. 25, 2003 (TW) ..... 92136815 A

(51) Int. Cl.
*H01J 17/49* (2006.01)

(52) U.S. Cl. ..... 313/582; 313/583; 313/584; 313/292

(58) Field of Classification Search ..... 257/797; 313/581, 292, 582–584
See application file for complete search history.

(56) References Cited

U.S. PATENT DOCUMENTS 6,376,986 B1 * 4/2002 Takagi et al. ..... 313/582
6,495,967 B2 * 12/2002 Kao et al. ..... 315/169.4
6,522,075 B2 * 2/2003 Koshio et al. ..... 313/586
6,806,645 B2 * 10/2004 Choi ..... 313/582
6,819,046 B2 * 11/2004 Hirano ..... 313/582
7,098,594 B2 * 8/2006 Yoon et al. ..... 313/582
2003/0132709 A1 * 7/2003 Harada et al. ..... 313/582

FOREIGN PATENT DOCUMENTS

JP 2000-011894 * 1/2000
JP 2003288842 10/2003
KR 2002019353 * 3/2002

OTHER PUBLICATIONS

China Office Action mailed Nov. 17, 2006.

* cited by examiner

*Primary Examiner*—Monica Lewis
(74) *Attorney, Agent, or Firm*—Thomas, Kayden, Horstemeyer & Risley

(57) ABSTRACT

An alignment mark for a plasma display panel (PDP). The alignment mark comprises a first and a second alignment patterns installed on a front and a rear substrate respectively. The second alignment pattern on the non-display area is simultaneously formed with the rib barrier formation on the display area of the rear substrate, wherein the second alignment pattern is hexagonal-honeycomb. The first alignment pattern on the front substrate is simultaneously formed with the non-transparent material fabrication, such as a bus electrode or black matrix fabrication, and corresponds to a space within the second alignment pattern. The first alignment pattern comprises at least one line segment, parallel to at least one side of the hexagonal honeycomb pattern on the rear substrate with a predetermined distance therebetween.

11 Claims, 4 Drawing Sheets

ALIGNMENT MARK AND PLASMA DISPLAY PANEL COMPRISING THE ALIGNMENT MARK

BACKGROUND OF THE INVENTION

1. Field of the Invention

The present invention relates to a plasma display panel (PDP), and more specifically to an alignment mark for assembling a plasma display panel.

2. Description of the Related Art

Recently, a variety of flat panel displays, including liquid crystal displays (LCDs) and plasma display panels (PDPs) have been intensively developed to replace cathode ray tube (CRT) displays. The PDP luminescent principle follows. Ultraviolet light is first produced from gas plasma and emitted to excite red (R), blue (B), and green (G) phosphors, then multifarious visible light is produced by mixing these three primary colors.

A conventional PDP fabrication comprises the following steps. The front substrate comprising the formation of transparent electrodes, bus electrodes, a dielectric layer, and a protective layer is fabricated. The rear substrate comprising the formation of address electrodes, rib barriers, and RBG phosphors is then fabricated. Finally, assembly of the PDP comprising alignment for a front and rear substrates to form a discharge space, vacuuming the discharge space, conducting mixed gas used to discharge into the discharge space until proper pressure, and detecting the luminescent stability in the discharge space is performed.

FIG. 1 is a cross section of a conventional plasma display panel. A front substrate structure 10 comprises a glass substrate 11 with a pair front electrodes 12, 14 installed in parallel thereon, a dielectric layer 16 covering the glass substrate 11 and the front electrodes 12, 14, and a protective layer 18 formed on the dielectric layer 16, wherein the front electrodes 12, 14 comprise transparent electrodes 12A, 14A and bus electrodes 12B, 14B respectively.

The transparent electrode may comprise Indium-Tin-Oxide (ITO), and the bus electrode may comprise a metal material, such as Cr—Cu alloy, to increase the conductivity of the front electrodes. A rear substrate structure 20 comprises a glass substrate 21 with a lengthwise address electrode 22 installed thereon, a dielectric layer 24 covering the lengthwise address electrode 22, rib barriers 25 disposed on the dielectric layer 24 and dividing the space above the dielectric layer 24 into a plurality of cells, such as a plurality of rectangular or hexagonal cells.

RBG Phosphors 26 coated on the sidewalls of the rib barriers 25 and the dielectric layer 24 to form three-primary-color luminescent cells. A pixel comprises R, B, and G luminescent cells adjacent to each other. The front electrodes 12, 14 are perpendicular to the address electrode 22.

For luminance efficiency and quality assurance, it is necessary that the electrodes 12, 14 on the front substrate are accurately aligned with the center of the luminescent cells divided by the rib barriers 25 on the rear substrate, and are perpendicular to the address electrode 22 on the rear substrate structure 20.

Therefore, alignment accuracy during assembly is important to PDP quality. In other words, if the front electrodes 12, 14 are shifted from the center of the luminescent cells on the rear substrate, it may reduce excitation efficiency of inert gas within the luminescent cells, decreasing luminance efficiency and affecting color uniformity.

For improving alignment accuracy, in general, alignment marks are additionally installed on the outside of the front and rear substrates respectively.

SUMMARY OF THE INVENTION

Accordingly, an object of the present invention is to provide an alignment mark for a plasma display panel (PDP) to reduce alignment errors and improve alignment accuracy.

To achieve the object, the present invention provides an alignment mark comprising a first and second alignment patterns installed on a front and rear substrate respectively. The second alignment pattern on the non-display area is simultaneously formed with the rib barrier formation on the display area of the rear substrate, wherein the second alignment pattern is hexagonal-honeycomb.

The first alignment pattern on the front substrate is simultaneously formed with the non-transparent material fabrication, such as a bus electrode or black matrix fabrication, and corresponds to a space within the second alignment pattern. The first alignment pattern comprises at least one line segment, parallel to at least one side of the hexagonal honeycomb pattern on the rear substrate with a predetermined distance.

The features of the invention are the second alignment pattern on the non-display area is simultaneously formed with the rib barrier formation on the display area of the rear substrate, and the first alignment pattern corresponding to the hexagonal honeycomb rib barrier on the front substrate is simultaneously formed with the non-transparent material fabrication, such as a bus electrode or black matrix fabrication.

DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
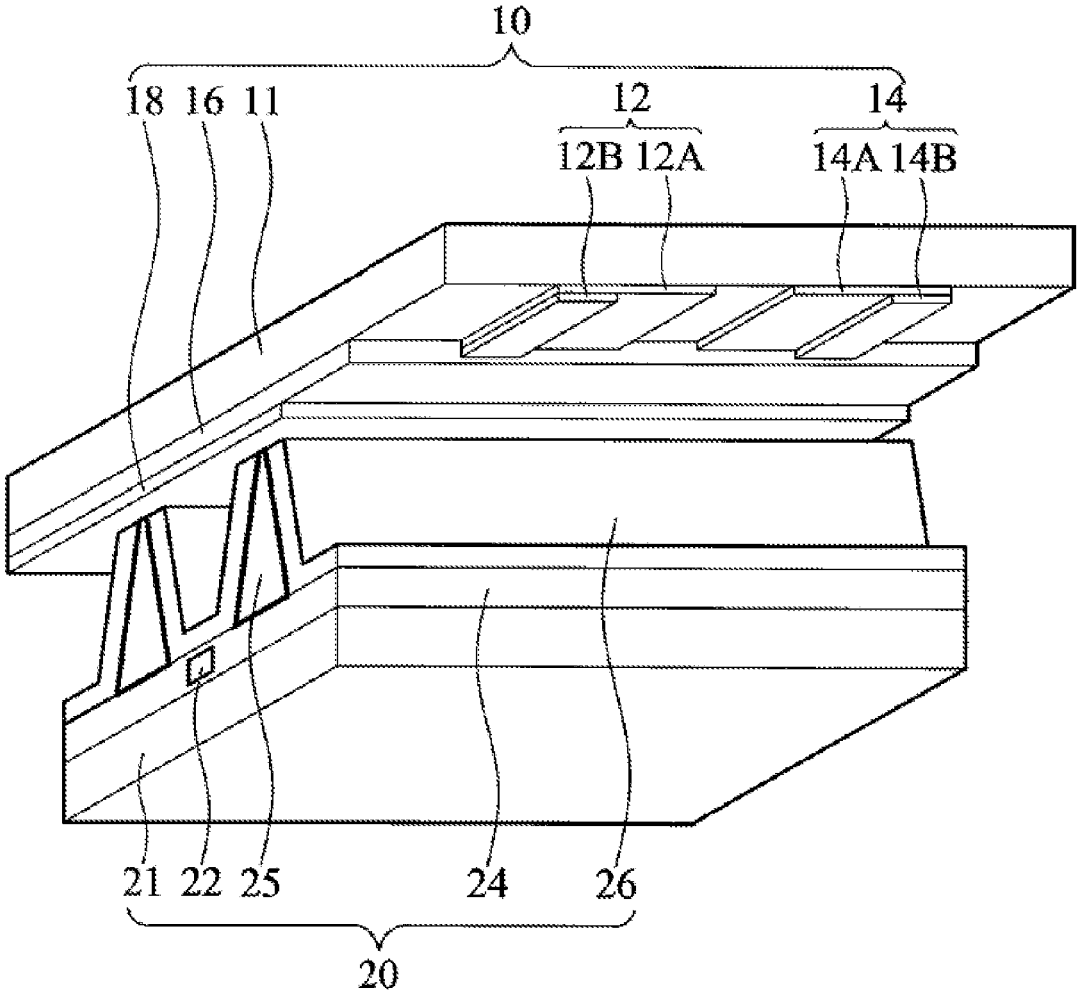
FIG. 1 (RELATED ART)
FIG. 1 illustrates a conventional plasma display panel structure.
Figure 2A:
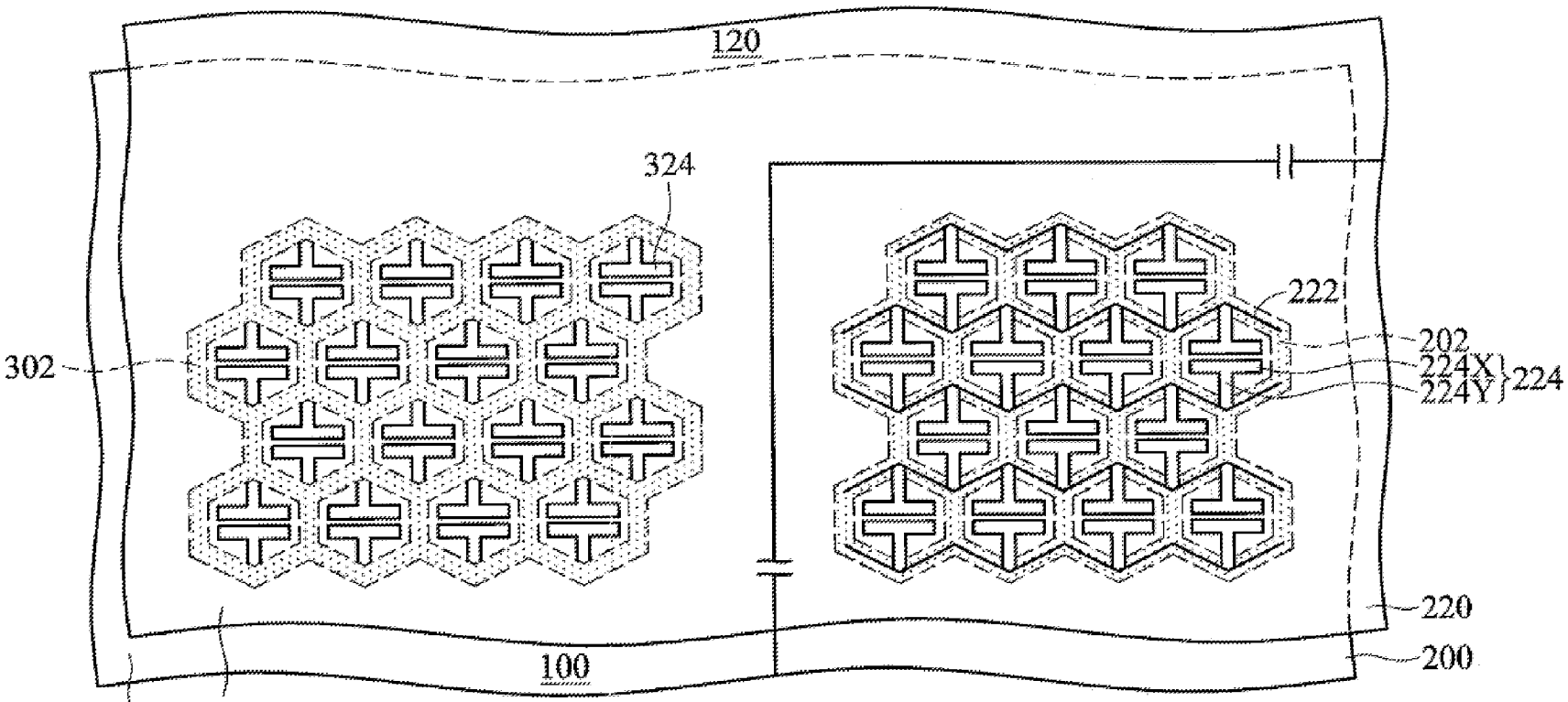
FIG. 2A is a plane view of an alignment relationship between the front and rear substrates of the plasma display panel according to the invention.

An alignment relationship between a front and a rear substrate of a PDP is illustrated in FIG. 2A. The rear substrate 100 and the front substrate 120 are divided into display areas 200, 220 and non-display areas 300, 320. Hexagonal honeycomb patterns 202 are formed by rib barriers on the display area 200 of the rear substrate 100, and each hexagonal rib is coated with RBG phosphors (not shown) to form luminescent cells.

It is noted that the hexagonal rib barrier may be hexagonal honeycomb or flat hexagonal honeycomb (as shown in FIG. 2A), and the hexagonal pattern may be enclosed (as shown FIG. 2A) or have openings for injecting and exhausting inert gas.

A plurality of pairs of T-shaped transparent electrodes 224 are installed on the display area 220 of the front substrate 120, and correspond to the hexagonal luminescent cells 202 on the display area 200 of the rear substrate 100. The transparent electrode may comprise ITO, and each transparent electrode is constituted by an X-directional electrode 224X and a Y-directional electrode 224Y.

A plurality of bus electrodes 222 are also installed on the front substrate 120, and correspond to the patterns of the hexagonal honeycomb rib barriers 202 on the display area 200 of the rear substrate 100 thus forming a saw-toothed profile 222. Bus electrode 222 may comprise metal or conductive materials, such as Cr—Cu alloy.

The Y-directional transparent electrode 224Y is connected to the tip portion of the saw-toothed bus electrode 222, namely, after two substrates are assembled, the Y-directional transparent electrodes 224Y are connected to the corner of the hexagonal honeycomb rib barriers 202, thus two opposite X-directional transparent electrodes 224X are parallel.

In order for the transparent electrodes 224 and the bus electrode 222 formed on the display area 220 of the front substrate 120 to accurately correspond to the luminescent cells divided by the rib barriers 202 on the display area 200 of the rear substrate 100, the present invention provides an alignment mark on the non-display area of the rear and front substrates 100 and 120.

Referring to FIG. 2A, hexagonal honeycomb patterns 302 on the non-display area 300 of the rear substrate 100 are simultaneously formed with the rib barrier formation on the display area 200 of the rear substrate 100, and alignment patterns, corresponding to the hexagonal honeycomb patterns 302, on the non-display area 320 of the front substrate 120 are also simultaneously formed with the non-transparent material fabrication, such as the bus electrode or black matrix fabrication.

The alignment pattern comprises at least one line segment, parallel to at least one side of the hexagonal honeycomb pattern 302 on the rear substrate 300 with a predetermined distance, the line segment comprises an isolated line segment or a line segment of a portion of a pattern profile. The preferable alignment marks on the front substrate 120 according to the invention are illustrated in FIGS. 2B~2E.

Figure 2B:
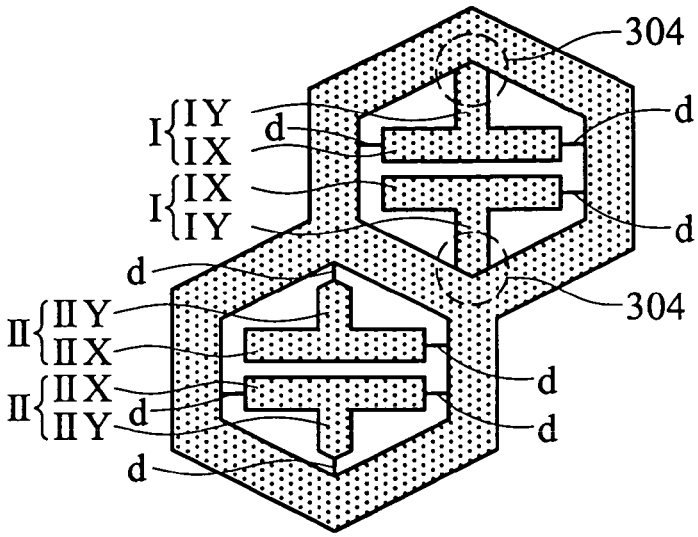
FIGS. 2B~2E are plane views of alignment marks for plasma display panels according to the invention.

FIG. 2B is a plane view of an example of an alignment mark for a plasma display panel according to the invention. In FIG. 2B, the alignment mark comprises hexagonal honeycomb alignment patterns 302 and T-shaped alignment patterns I corresponding to the alignment patterns 302. The honeycomb alignment patterns 302 are disposed on the non-display area 300 of the rear substrate 100, and the T-shaped alignment patterns I are disposed on the front substrate 120.

The T-shaped alignment pattern is constituted by a rectangle IX and a horn column IY, wherein the angle of the horn column IY is the same as the angle 304 of the hexagonal honeycomb. Therefore, when two substrates are assembled, the tip portion of the horn column IY is aligned with the corner 304 of the hexagonal honeycomb, that is, "Faced Alignment". Additionally, a predetermined distance d may be measured for the alignment interstice control. As a result, two opposite rectangles IX are parallel, and they are parallel to one side of the hexagonal pattern 302 with the predetermined distance d.

Besides the pattern I, the T-shaped alignment pattern also comprises the pattern II. Referring to FIG. 2B, the T-shaped alignment pattern II is constituted by a rectangle IIX and a horn column IIY, wherein the angle of the horn column IIY is the same as the angle 304 of the hexagonal honeycomb.

Therefore, when two substrates are assembled, the tip portion of the horn column IIY is aligned with the corner 304 of the hexagonal honeycomb. Additionally, a predetermined distance d may be measured for the alignment interstice control. As a result, two opposite rectangles IX are parallel, and the rectangle IIX and horn column IIY are both parallel to one side of the hexagonal pattern 302 with the predetermined distance d.

Figure 2C:
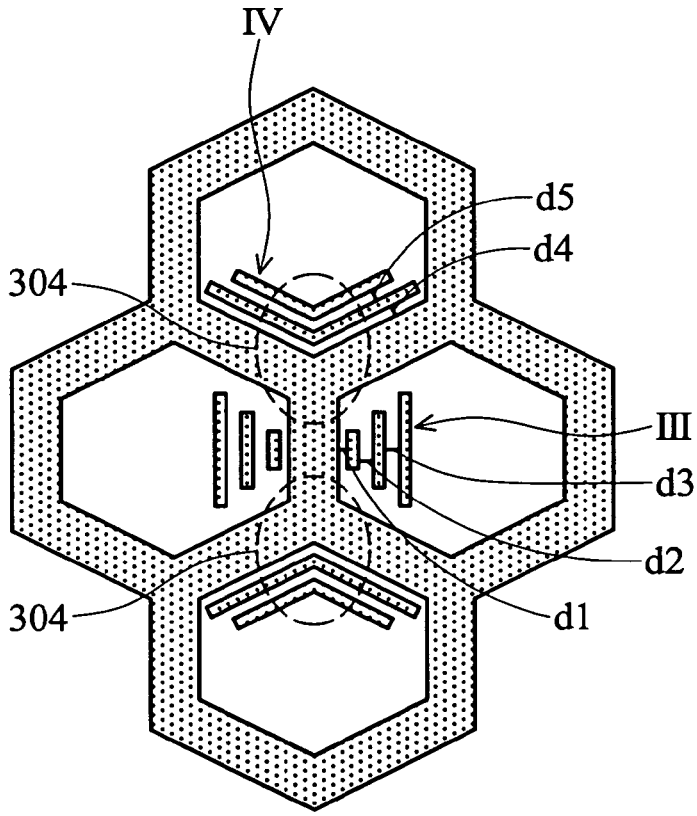

FIG. 2C is a plane view of another example of an alignment mark for a plasma display panel according to the invention. In FIG. 2C, the alignment mark comprises hexagonal honeycomb alignment patterns 302 and a plurality of parallel line segments III corresponding to the alignment patterns 302. The honeycomb alignment patterns 302 are disposed on the non-display area 300 of the rear substrate 100, and the parallel line segments III are disposed on the front substrate 120.

When alignment is performed between the front and rear substrates, the set of parallel line segments III is parallel to one side of the hexagonal alignment pattern 302 with d1, d2, and d3 respectively. Additionally, the set of parallel line segments III can be an "Alignment Yardstick" for adjusting the position of the front substrate 120 or the rear substrate 100.

Besides the line segment pattern III, the yardstick alignment pattern also comprises a set of V-shaped line segments IV parallel to each other. The angle of the V-shaped line segment IV is the same as the angle 304 of the hexagonal honeycomb pattern 302. Therefore, when two substrates are assembled, the tip portion of the V-shaped line segment IV is aligned with the corner 304 of the hexagonal honeycomb pattern 302, and the V-shaped line segments IV are parallel to one side of the hexagonal honeycomb pattern 302 with two predetermined distances d4 and d5. As a result, the set of V-shaped line segments IV can serve as both the "Alignment Yardstick" and "Faced Alignment".

Figure 2D:
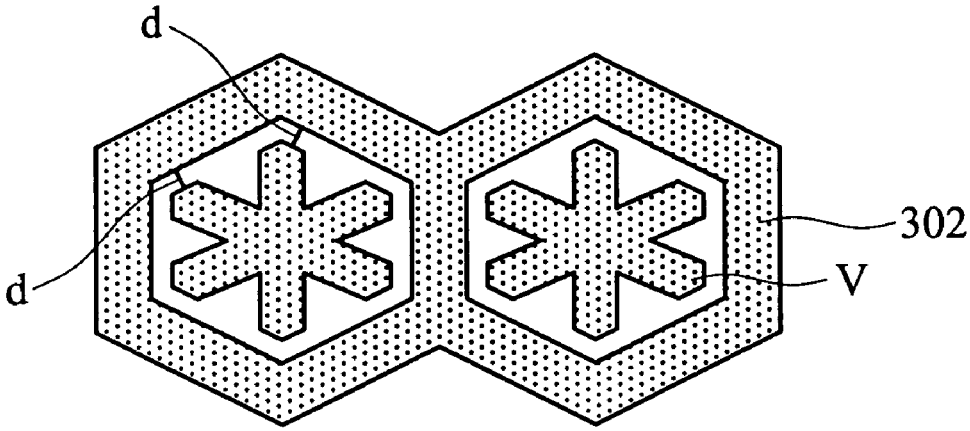

FIG. 2D is a plane view of another example of an alignment mark for a plasma display panel according to the invention. In FIG. 2D, the alignment mark comprises hexagonal honeycomb alignment patterns 302 and hexagonal star-column patterns V corresponding to the alignment patterns 302.

The honeycomb alignment patterns 302 are disposed on the non-display area 300 of the rear substrate 100, and the hexagonal star-column patterns V are disposed on the front substrate 120, wherein the tip portion of the hexagonal star-column pattern V is V-shaped, and six columns are extended from the same center.

When alignment is performed between the front and rear substrates, six columns of the hexagonal star-column pattern V correspond to each corner of the hexagonal alignment pattern 302 respectively. The tip portion of the hexagonal star-column pattern V is parallel to one side of the hexagonal honeycomb pattern 302 with a predetermined distance d. As a result, the hexagonal star-column pattern V can be used as the "Alignment Yardstick" and "Faced Alignment".

Figure 2E:
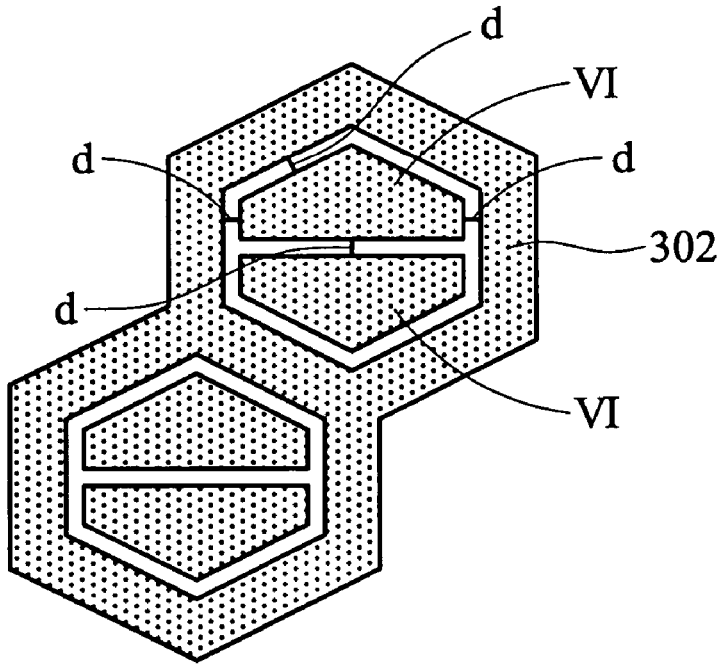

FIG. 2E is a plane view of another example of an alignment mark for a plasma display panel according to the invention. In FIG. 2E, the alignment mark comprises hexagonal honeycomb alignment patterns 302 and a set of two pentagonal patterns VI corresponding to the alignment patterns 302.

The honeycomb alignment patterns 302 are disposed on the non-display area 300 of the rear substrate 100, and the set of two pentagonal patterns V is disposed on the front substrate 120, wherein the two pentagonal patterns V are opposite and their bottom lines are parallel with each other with a predetermined distance d, each pentagonal pattern comprises two right angles and three non-right angles, and the three non-right angles are the same as the three corresponding angles of the hexagonal honeycomb pattern 302 respectively.

When alignment is performed between the front and rear substrates, the three non-right angles of the pentagonal pattern VI are aligned with the three corresponding corners of the hexagonal alignment pattern 302, and the pattern profile of the pentagonal pattern VI is parallel to one side of the hexagonal honeycomb pattern 302 with a predetermined distance d. As a result, the pentagonal pattern VI can be used as the "Alignment Yardstick" and "Faced Alignment".

The I, II, III, IV, V, and VI alignment patterns, or combinations thereof may be installed on the non-display area 320 of the front substrate 120 to maintain alignment accuracy. Additionally, the I, II, III, IV, V, and VI alignment patterns may be filled with the bus electrode material or hollow.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A plasma display panel (PDP), comprising:

a front substrate comprising a first display area and a first non-display area;

the front substrate comprising a bus electrode disposed in the first display area, and a first pattern disposed in the first non-display area comprising at least one line segment isolated from the bus electrode, the at least one line segment installed on the predetermined assembling position thereof; and a rear substrate comprising a second display area and a second non-display area;

the rear substrate comprising a second pattern disposed in the second non-display area pattern comprising at least one hexagonal honeycomb pattern formed with rib barriers disposed in the second display area installed on the predetermined assembling position thereof, wherein the projection of the line segment is substantially parallel to at least one side of the hexagonal honeycomb pattern with a predetermined distance therebetween.

2. The plasma display panel as claimed in claim 1, wherein the first pattern comprises a plurality of parallel line segments.

3. The plasma display panel as claimed in claim 1, wherein the first pattern comprises a V-shaped line segment, and the angle thereof is the same as the angle of the hexagonal honeycomb pattern of the second pattern, when alignment is performed, the angle of the V-shaped pattern is aligned with the corner of the hexagonal honeycomb pattern, thus these two pattern profiles are parallel with each other with a predetermined distance therebetween.

4. The plasma display panel as claimed in claim 1, wherein the first pattern comprises a hexagonal star-column pattern with the same center, the tip portion thereof is V-shaped, and each angle of the six columns corresponds to the six corners of the hexagonal honeycomb pattern of the second pattern respectively, when alignment is performed, six angles of the second pattern are aligned with the six corners of the first pattern respectively, and two pattern profiles are parallel to each other with a predetermined distance therebetween.

5. The plasma display panel as claimed in claim 1, wherein the first pattern comprises a T-shaped pattern comprising a horn column and a rectangle, and the angle of the horn column is the same as the angle of the hexagonal honeycomb pattern of the second pattern, when alignment is performed, the horn column is aligned with the corner of the hexagonal honeycomb pattern of the second pattern, and two pattern profiles are parallel to each other with a predetermined distance therebetween.

6. The plasma display panel as claimed in claim 1, wherein the first pattern comprises a first and a second T-shaped pattern comprising a first and a second horn column and a first and a second rectangle respectively, the first and second rectangles are parallel with each other, and the angles of the first and second horn columns are the same as the opposite angles of the hexagonal honeycomb pattern of the second pattern respectively, when alignment is performed, the first and second horn columns are aligned with the opposite corners of the hexagonal honeycomb pattern of the second pattern, and two pattern profiles are parallel to each other with a predetermined distance therebetween.

7. The plasma display panel as claimed in claim 1, wherein the first pattern comprises a T-shaped pattern comprising a horn column and a rectangle, and the angle of the horn column is the same as the angle of the hexagonal honeycomb pattern of the second pattern, when alignment is performed, the horn column is aligned with the corner of the hexagonal honeycomb pattern of the second pattern, and two pattern profiles overlap.

8. The plasma display panel as claimed in claim 1, wherein the first pattern comprises a first and a second T-shaped pattern comprising a first and a second horn column and a first and a second rectangle respectively, the first and second rectangles are parallel with each other, and the angles of the first and second horn columns are the same as the opposite angles of the hexagonal honeycomb pattern of the second pattern respectively, when alignment is performed, the first and second horn columns are aligned with the opposite corners of the hexagonal honeycomb pattern of the second pattern, and two pattern profiles overlap.

9. The plasma display panel as claimed in claim 1, wherein the first pattern comprises a pentagon comprising two right angles and three non-right angles, and the three non- right angles are the same as the three corresponding angles of the hexagonal honeycomb pattern of the second pattern respectively, When alignment is performed, the three non-right angles of the first pattern are aligned with the three corresponding corners of the second pattern, and two pattern profiles are parallel therebetween.

10. The plasma display panel as claimed in claim 1, wherein the first pattern comprises a first and second pentagons comprising two right angles and three non-right angles, and the three non-right angles are the same as the three corresponding angles of the hexagonal honeycomb pattern of the second pattern respectively, when alignment is performed, the three non- right angles of the first pattern are aligned with the three corresponding corners of the second pattern, and two pattern profiles are parallel.

11. The plasma display panel as claimed in claim 1, wherein the bus electrode comprises non-transparent bus electrode material or black matrix material.

* * * * *